United States Patent [19]

Walker

[11] 3,999,902

[45] Dec. 28, 1976

[54] SLANT AXIS ROTARY MECHANISM WITH RELIEVED APEX PORTIONS

[75] Inventor: Donald F. Walker, Leamington, England

[73] Assignee: Caterpillar Tractor Co., Peoria, Ill.

[22] Filed: Nov. 5, 1975

[21] Appl. No.: 629,199

[52] U.S. Cl. ..... 418/51; 418/53

[51] Int. Cl.[2] ..... F01C 1/02; F04C 17/02; F01C 19/00

[58] Field of Search ..... 418/49–53, 418/61 A, 68; 73/258

[56] References Cited

UNITED STATES PATENTS 3,102,492 9/1963 Bentele et al. ..... 418/61 A

OTHER PUBLICATIONS

Clarke et al., A New Class of Rotary Piston Machine Suitable for Compressors, Pumps, and Internal Combustion Engines, Proceedings at Institute of Mechanical Engineers, 1972, vol. 186 62/72, pp. 743–753.

*Primary Examiner*—John J. Vrablik

*Attorney, Agent, or Firm*—Wegner, Stellman, McCord, Wiles & Wood

[57] ABSTRACT

An improved slant axis rotary mechanism including a housing defining an operating chamber having generally radially extending opposed side walls, a shaft having an angularly offset portion journalled in the housing with the angularly offset portion within the chamber and a rotor within the chamber journalled on the angularly offset portion. The rotor includes a peripheral flange and each side of the flange has plural apices thereon, each carrying seals engaging a corresponding one of the side walls. The flange sides are slightly relieved only in the vicinity of each apex whereby sufficient clearance to prevent interference between the rotor and the housing during operation is achieved without significantly diminishing the compression ratio of the mechanism. A method of fabricating a rotor for a slant axis rotary mechanism is also disclosed.

4 Claims, 2 Drawing Figures

SLANT AXIS ROTARY MECHANISM WITH RELIEVED APEX PORTIONS

BACKGROUND OF THE INVENTION

This invention relates to rotary mechanisms and, more particularly, to slant axis rotary mechanisms which may be used as engines, pumps, compressors, or the like.

According to theory, slant axis rotary mechanisms are capable of developing extremely high compression ratios. However, to achieve such high ratios, it is necessary that the clearances between the sides of the rotor flange and the side walls of the housing, at the minimum volume position, be kept extremely small. In other words, the rotor must be made as large as possible in terms approaching the envelope defined by the side walls and yet just clear the walls when rotated within it.

Heretofore, it has been impossible to achieve compression ratios near those theoretically possible due to manufacturing tolerances and distortions and/or deflections of component parts during operation of the mechanism. In order to avoid interference between the housing and the rotor during operation, it has been proposed that the rotor be uniformly shrunk from its theoretical size around the entire periphery of the flange on both sides thereof. Such an approach materially reduces the compression ratio of the device, with the consequence that its efficiency is significantly reduced.

SUMMARY OF THE INVENTION

It is the principal object of the invention to provide a new and improved slant axis rotary mechanism for use as an engine, pump, compressor, or the like. More specifically, it is an object of the invention to provide such a mechanism wherein interference between the housing and the rotor is eliminated, while a high compression ratio is maintained.

The exemplary embodiment of the invention achieves the foregoing object in a slant axis rotary mechanism including a housing defining an operating chamber having generally radially extending opposed side walls. A shaft having an angularly offset portion is journalled in the housing with the angularly offset portion disposed within the chamber. A rotor is within the chamber and is journalled on the angularly offset portion. The rotor includes a peripheral flange and the flange has plural apices on each side thereof, each carrying a seal to sealingly engage a corresponding one of the side walls. In order to provide sufficient clearance to prevent interference between the rotor and the housing and yet maintain high combustion ratios, the flanged sides are slightly relieved only in the vicinity of each apex.

According to a highly preferred embodiment, the relief extends to no more than about 30° to each side of each apex and the greatest relief is provided at each apex and is progressively diminished to each side of the apex.

A method of fabricating a rotor according to the invention includes the steps of selecting a theoretical housing envelope for the rotor and fabricating a rotor to theoretically optimally fit the housing envelope while providing reliefs on the sides of the rotor flange only at the apices thereon and in the immediate vicinity thereof.

Other objects and advantages will become apparent from the following specification taken in connection with the accompanying drawings.

DESCRIPTION OF THE PREFERRED EMBODIMENT

Figure 1:
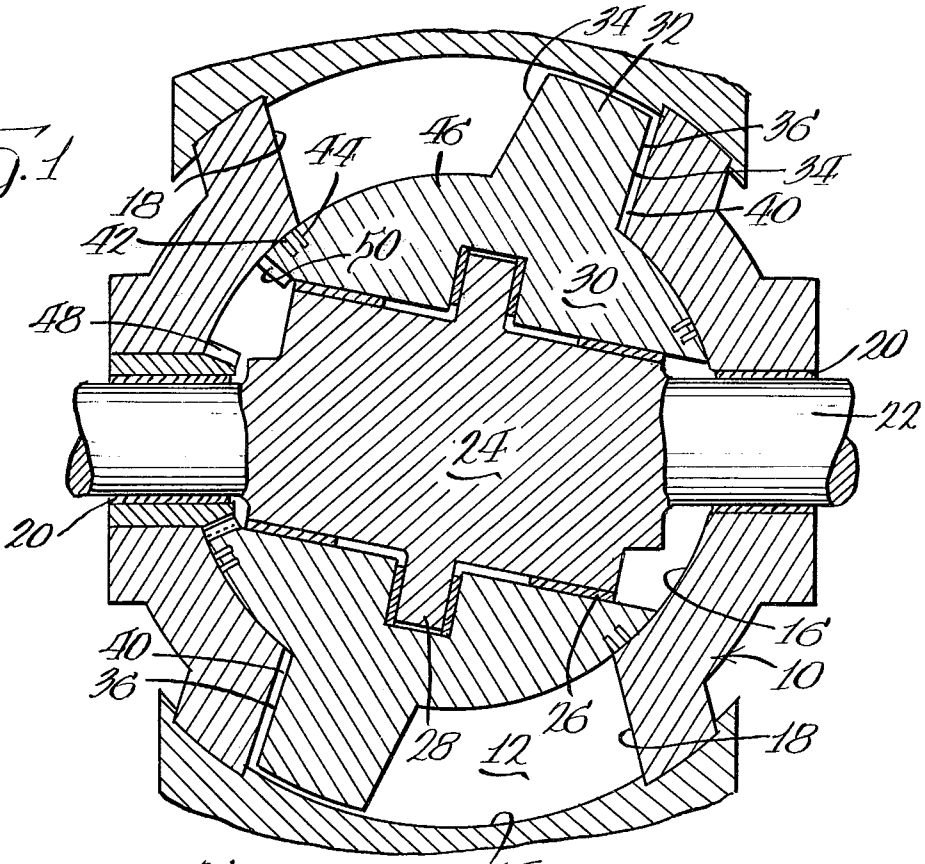
FIG. 1 is a sectional view of a slant axis rotary mechanism made according to the invention.
Figure 2:
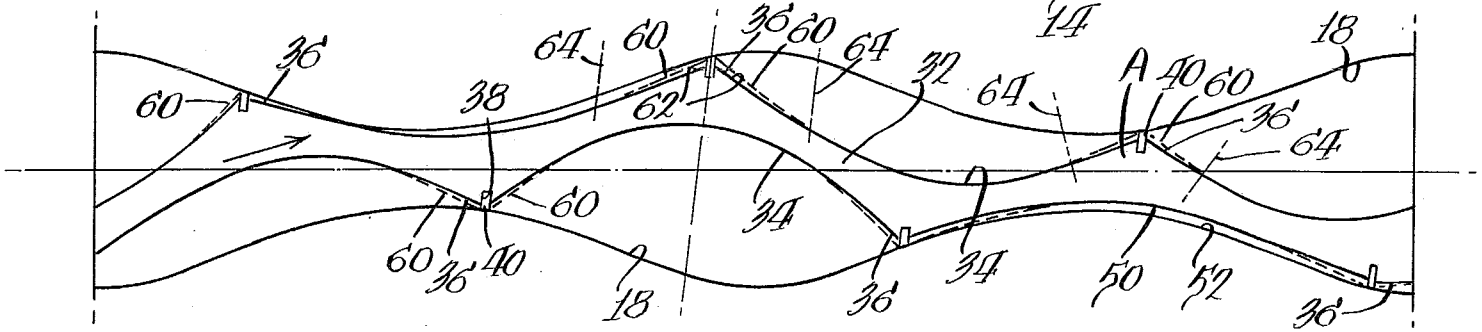
FIG. 2 is a developed view of the periphery of the rotor flange of a four-cycle mechanism wherein the shaft angle is at 45° from a starting point and the rotor angle is at 15° from the same starting point.

This invention is an improvement in the type of rotary mechanism disclosed in U.S. Pat. No. 3,485,218, dated Dec. 23, 1969 to J. M. Clarke, the details of which are herein incorporated by reference. As disclosed by Clarke, such mechanisms may be employed as engines, pumps, compressors, etc., with varying number of cycles, normally two or four. The mechanism is illustrated in FIG. 1 and is seen to include a housing, generally designated 10, defining an operating chamber 12. The operating chamber 12 is bounded by a radially outer spherical wall 14, a radially inner spherical wall 16, and opposed, generally radially extending side or end walls 18. Those skilled in the art will recognize that the precise configuration of the end walls 18 will vary depending upon the number of cycles of employed. For example, for a two-cycle mechanism, the walls 18 will be substantially planar, while for a four-cycle mechanism, the walls 18 will be frustoconical with an undulating conical surface. FIGS. 1 and 2 herein illustrate a four-cycle mechanism.

By means of suitable bearings 20, the housing 10 journals a shaft 22 having an angularly offset portion 24 within the operating chamber 12. Suitable bearings 26 and a thrust collar 28 journal a rotor 30 within the operating chamber 12. The rotor 30 has a peripheral flange 32, each side 34 of which is provided with plural, generally radially extending apices 36.

As best illustrated in FIG. 2, at each apex 36, a groove 38 is radially disposed for receipt of an apex seal 40 which sealingly engages the corresponding one of the side walls 18. The number of apices 36 on each side of the flange 32 will vary, depending upon the number of cycles of the mechanism. For example, in a two-cycle mechanism, there will be two apices on each side of the flange 32, while for a four-cycle mechanism, as illustrated in FIG. 2, there will be three such apices on each side of the flange 32.

The basic system is completed by the provision of oil and gas seals 42 and 44, respectively, on the hub 46 of the rotor along with a timing gear 48 meshed with an internal ring gear 50 carried by the rotor 30. Finally, peripheral seals (not shown) on the radially outer edge of the rotor flange 32 are provided for sealing engagement with the outer spherical surface 14.

The factors and formulas for developing the shape of the operating chamber 12 are set forth in considerable detail in the previously identified Clark patent and will not be repeated herein. Similarly, the shape of the rotor flange 32 is theoretically developed by choosing the same such that it may move within the operating chamber without interference, just clearing the walls thereof. As will be appreciated by those skilled in the art, based upon theoretical considerations, extremely high compression ratios can be achieved. For example, at a socalled "top dead center" position, that portion 50 (FIG. 2) of the rotor flange side 34 between adjacent apices 36 will be very nearly coextensive with the corresponding portion 52 of the associated housing end wall 18. This relationship is not shown precisely in FIG. 2 in that, as stated previously, the same is a developed view wherein the rotor angle is 15° in advance of such a top dead center position.

It will also be recognized by those skilled in the art that fluids under pressure act against the sides of the rotor flange at the portion 50 due to compression, if the mechanism is used as a pump or compressor, or due to the combined effects of compression and combustion if the mechanism is employed as an engine. Consequently, the apex 36 opposite from the portion 50, designated A in FIG. 2, will be driven upwardly in that Figure. If the sides 34 of the rotor flange 32 are configured according to their theoretical optimum, such deflection will result in interference between the apex A and the corresponding side wall 18. Such a theoretical configuration is illustrated by dotted lines 60 in FIG. 2. Thus, in order to preclude the possibility of such interference and yet maintain high compression ratios, each of the apices 36 is relieved at the apex and in the immediate vicinity thereof. FIG. 2 shows such a relief in exaggerated form, it being that portion of the rotor side between the lines 60 and 62.

It has been determined that such relief need only extend angularly for 30° to each side of each apex 36 as indicated by lines 64 appearing in FIG. 2. And, the degree of relief progressively diminishes as the outer limit represented by the lines 64 is approached. In other words, the degree of relief is the greatest at the apex 36 and diminishes therefrom.

It has been found that relief in the area between adjacent apices and bounded by the lines 64 is not required. Consequently, there is no relief for fully half of the periphery of each rotor flange side 34 and only varying degrees of relief on the remaining half. Thus, the compression ratio can be maintained much closer to the theoretical compression ratio while the possibility of interference is eliminated.

The degree of relief at each apex 36 will vary, depending upon the actual configuration of the mechanism and the use to which it is put. For example, pumps and compressors do not require as great a relief at the apices as would an engine, since lower pressures are encountered and thus there will be less deflection. In engines, geometric concerns regarding flange thickness and working chamber surface area will govern the maximum amount of relief. In one example involving a 50 KW engine, the necessary relief at each apex 36 would be on the order of 0.25 mm.

In general, maximum relief will be the sum of the design manufacturing tolerances for side-to-side movement of the rotor within the operating chamber and the calculated deflection for the maximum operating pressure encountered.

From the foregoing, it will be appreciated that a rotor can be simply fabricated by choosing the theoretical envelope for the housing and fabricating the rotor to fit the envelope in a theoretically optimum way, providing relief only at the apices and in the immediate vicinity thereof. Lost compression is substantially diminished thereby maximizing efficiency of the mechanism. In pumps or compressors, volumetric efficiency is maximized due to high compression ratio possibilities, while in engines, power output is maximized for the reason that compression ratios may be maximized and brought to a point much closer to the theoretical compression ratio than with such mechanisms heretofore known.

What is claimed is:

1. A slant axis rotary mechanism comprising:

a housing defining an operating chamber having generally radially extending, opposed side walls;

a shaft having an angularly offset portion journalled in said housing with said angularly offset portion within said chamber;

a rotor within said chamber and journalled on said angularly offset portion;

a peripheral flange on said rotor, said flange having plural apices on each side thereof, each carrying seals sealingly engaging a corresponding one of said side walls, said flange sides being slightly relieved from their theoretical envelopes only in the vicinity of each apex, whereby sufficient clearance to prevent interference between said rotor and said housing during operation is achieved without significantly diminishing the compression ratio of the mechanism.

2. A slant axis rotary mechanism comprising:

a housing defining an operating chamber having generally radially extending, opposed side walls;

a shaft having an angularly offset portion journalled in said housing with said angularly offset portion within said chamber;

a rotor within said chamber and journalled on said angularly offset portion;

a peripheral flange on said rotor, said flange having plural apices on each side thereof, each carrying seals sealingly engaging a corresponding one of said side walls, said flange sides being relieved from their theoretical envelope to no more than about 30° to each side of each apex, said flange sides being slightly relieved only in the vicinity of each apex, whereby sufficient clearance to prevent interference between said rotor and said housing during operation is achieved without significantly diminishing the compression ratio of the mechanism.

3. The rotary mechanism of claim 2 wherein the greatest relief is provided at each apex and is progressively less to each side thereof.

4. A method of constructing a rotor having a peripheral flange with each flange side having plural apices for use in a slant axis rotary mechanism comprising the steps of, selecting a theoretical housing envelope for said rotor, and fabricating a rotor to theoretically optimally fit said housing envelope while providing reliefs on said sides only at the apices thereon and in the immediate vicinity thereof.

* * * * *